United States Patent [19]

Peterson, III

[11] 4,068,428

[45] Jan. 17, 1978

[54] INSULATION WINDOW

[76] Inventor: O. James Peterson, III, 2841 River Oaks Drive, Midlothian, Va. 23113

[21] Appl. No.: 735,221

[22] Filed: Oct. 22, 1976

[51] Int. Cl.[2] ..... E05C 21/02

[52] U.S. Cl. ..... 52/202; 49/61; 52/213; 52/DIG. 13; 160/354

[58] Field of Search ..... 52/202, DIG. 13, 213; 49/61, 465; 160/354, 369

[56] References Cited

U.S. PATENT DOCUMENTS

| | | | |
|---|---|---|---|
| 2,514,316 | 7/1950 | Dobrin | 49/61 X |
| 3,214,879 | 11/1965 | Ellingson et al. | 52/202 X |
| 3,251,399 | 5/1966 | Grossman | 52/DIG. 13 |
| 3,381,416 | 5/1968 | de Torres et al. | 52/202 X |
| 3,583,057 | 6/1971 | Kolozsvary | 52/DIG. 13 |
| 3,616,838 | 11/1971 | Barr | 52/DIG. 13 |
| 3,668,808 | 6/1972 | Perina | 52/DIG. 13 |

FOREIGN PATENT DOCUMENTS

| | | | |
|---|---|---|---|
| 234,044 | 8/1960 | Australia | 52/DIG. 13 |
| 1,154,755 | 6/1969 | United Kingdom | 52/202 |

*Primary Examiner*—J. Karl Bell

*Attorney, Agent, or Firm*—Griffin, Branigan and Butler

[57] ABSTRACT

An insulation window to be mounted on internal, in situ, window frames of buildings comprises a sheet of 3/16 inch rigid transparent plastic. The plastic sheet has spaced "hook-and-loop" fastening elements adhered directly to the plastic sheet about the margin of an inner face thereof and complementary hook-and-loop fastening elements are attached to the window-casing frames of the building. A weather stripping is adhered directly to the plastic sheet about the margin of the inner face thereof.

17 Claims, 5 Drawing Figures

INSULATION WINDOW

BACKGROUND OF THE INVENTION

This invention relates generally to the art of windows, and more particularly, to auxiliary windows, such as storm windows, to improve the heat insulative properties of window assemblies.

The known prior art which relates most closely to this invention includes U.S. Pat. No. 3,251,339 to Grossman; U.S. Pat. No. 3,668,808 to Perina; U.S. Pat. No. 3,745,709 to Perina; U.S. Pat. No. 3,939,620 to Bero; U.S. Pat. No. D238,667 to Bero; and U.S. Pat. No. 2,514,316 to Dobrin. Other references which also relate to this invention include Australian Pat. No. 234,044 and U.S. Pat. No. 2,298,783 to Burnett; U.S. Pat. No. 2,741,306 to Warp; U.S. Pat. No. 2,943,676 to Grenci; U.S. Pat. No. 3,009,515 to Albee; U.S. Pat. No. 3,175,603 to Tonnon; U.S. Pat. No. 3,283,804 to Yancey; U.S. Pat. No. 3,583,057 to Kolozsvary; U.S. Pat. No. 3,616,838 to Barr; U.S. Pat. No. 3,753,458 to Lazarek; U.S. Pat. No. 3,797,167 to Gomboc; and U.S. Pat. No. 3,913,655 to Ogino.

Dobrin (U.S. Pat. No. 2 514,316) describes equipment for insulating a window. The equipment includes sheets of translucent material of the general character of "Plexiglas". In this case, an adhesive is coated onto the margins of the flexible plastic sheets and the plastic sheets are adhered to the sash frames of windows. A disadvantage of this arrangement is that it is difficult to remove the plastic sheets from the sash frames and, thereafter reuse the plastic sheets. Further, when the sheets are removed from the sash frames, the adhesive leaves marks on the sash frames. In addition, by attaching the sheets to the sash frames the points of adhesion are relatively visible. Finally, the flexible plastic of this invention easily wrinkles thereby making it readily visible to an observer and detracts from its appearance. In this respect, this patent does mention at column 3, lines 12–22 that the plastic could be a thicker and stiffer material, however, it does not set forth dimensions or a system in which such a thicker material is used.

To overcome the problems of Dobrin (U.S. Pat. No. 2,514,316), it is an object of this invention to provide an internally mounted insulating window which is not only difficult for an observer to see but which when an observer sees it, is attractive and luxurious looking. In addition, it is an object of this invention to provide an internal insulating window which can be easily removed from, and reattached to, a window-case frame without leaving unattractive marks thereon.

Grossman (U.S. Pat. No. 3,251,399) describes a similar flexible-plastic window cover which appears to have an outer frame for mounting a thread-like nap fastener about the entire periphery of the window cover. A complementary nap fastener is attached to the inside of a window frame again about its entire periphery. The window nap fastener engages the frame nap fastener to mount the window within the frame. This arrangement is somewhat complicated in that it involves the construction and mounting of frames. Further, this system is unattractive in that the nap fasteners are quite visible and the flexible plastic has a wrinkled look. Thus, it is an object of this invention to provide an internal insulating window which is uncomplicated to prepare and mount and which also is attractive.

The two Perina U.S. Pat. Nos. (3,745,709 and 3,668,808) describe hook and loop fasteners, such as "Velcro", used to attach normal glass windows to structures. In these patents, the windows are glass and are enclosed in frames or rims. The Velcro fasteners are then, in turn, attached to the rims. Again, it is somewhat complicated to prepare rims or frames for windows.

Finally, Bero (U.S. Pat. Nos. 3,939,620) and D238,667 describe a system for mounting plastic windows inside houses wherein plastic panel-holding strips are used as a border frame to support sheets of plastic. In this case, as in several of the previously mentioned cases, the panel-holding strips are mounted on a window-casing frame and the strips hold the panes. In this case, the panel-holding strips are rather unattractive looking and are complicated to work with. In this respect, not only must the window panes be prepared to desired sizes, but the frames must also be cut to specific lengths to accommodate the panes. Finally, although the thicknesses of the panes are not mentioned in these patents, the thicknesses of the panes actually sold by the assignee of these patents are relatively thin, and, therefore, do not have a strong luxurious appearance.

It is an object of this invention to provide an internal insulating window which:

can be easily prepared for mounting;
can be repetitively, easily mounted, and dismounted;
has good insulating qualities;
is difficult to detect;
presents a good appearance if detected; and,
is relatively inexpensive to manufacture.

SUMMARY OF THE INVENTION

According to principles of this invention, an insulating window includes a transparent, rigid sheet of plastic having spaced hook-and-loop fastening elements adhered directly thereto in areas about the margin of one face thereof. Complementary spaced hook-and-loop fastening elements are attached to the inside window frame of a house. A weather stripping is attached directly to the same face of the sheet of plastic about the margin thereof to form a seal between the sheet of plastic and the internal window-casing frame. The rigid sheet of plastic is approximately 3/16 inch thick.

BRIEF DESCRIPTIONS OF THE DRAWINGS

The foregoing and other objects, features and advantages of the invention will be apparent from the following more particular description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 2:
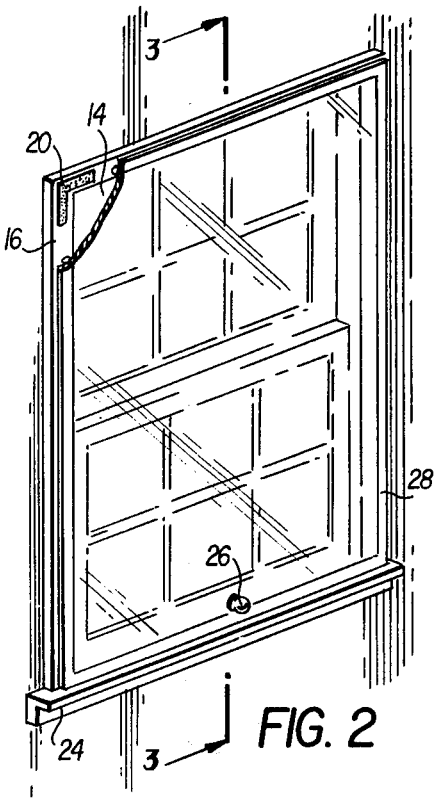
FIG. 2 is an isometric partially cutaway, view of the insulating window of FIG. 1 when it is mounted on a window frame.
Figure 1:
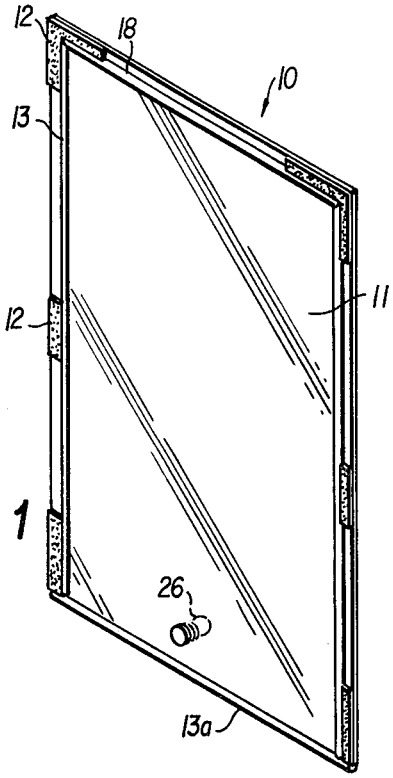
FIG. 1 is an isometric view of an insulating window employing principles of this invention.
Figure 3:
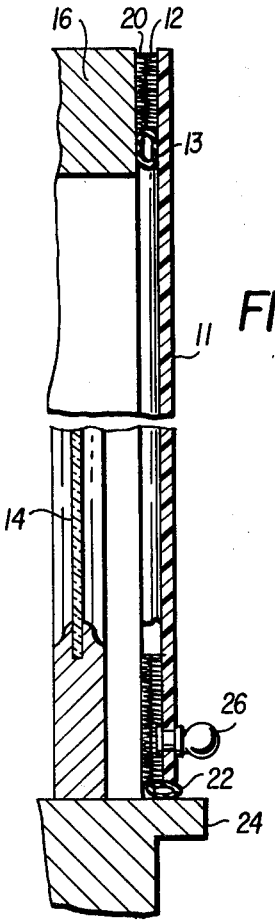
FIG. 3 is a sectional view taken on line 3–3 in FIG. 2.
Figure 4:
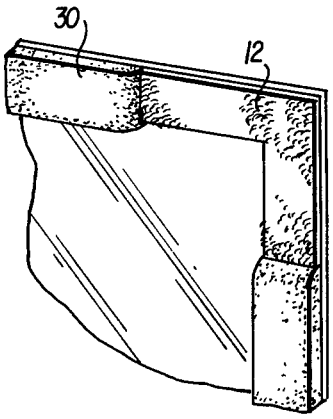
FIG. 4 is an isometric view of a portion of a second-embodiment insulating window employing principles of this invention.
Figure 5:
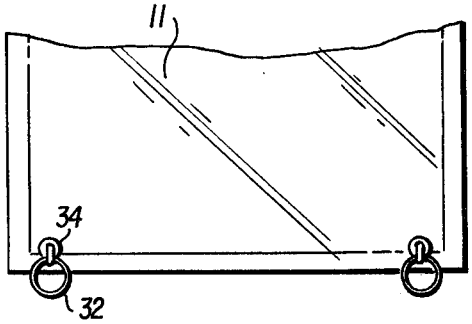
FIG. 5 is a front view of a portion of an insulation window of this invention including an embellishment that can be used with any of the embodiments of the invention.

Referring to the drawings, FIGS. 1–3 depict a first embodiment of the invention and FIGS. 4 and 5 depict a second embodiment of the invention. FIG. 5 includes an embellishment that can be used in both embodiments of the invention.

Describing first the embodiment of FIGS. 1–3, an insulating window 10 includes a transparent sheet of plastic 11; loop, hook-and-loop fastener elements 12; and weather stripping 14.

The transparent sheet of plastic is rigid and can be of the type sold under the Trademark "PLEXIGLAS". The transparent sheet of plastic should be at least ⅛ of an inch thick, and preferably, is 3/16 of an inch thick. In this respect, it is important that the plastic be rigid and resist bending to a great extent for purposes of appearance, attachment, and insulation as will be further described below. The transparent sheet of plastic 11 is cut to be larger than a window 14 so as to overlap a window-casing frame 16 about the margin 18 of the transparent sheet of plastic 11.

The loop, hook-and-loop fastener elements 12 and the weather stripping 13 are adhered directly to the transparent sheet of plastic 11 in the margin 18 on the side of the sheet of plastic which will face the window-casing frame 16. The loop fastener elements 12 are spaced from one another. The spacings between these elements are preferably between 10 and 12 inches to provide proper support for the transparent sheet of plastic on the window-casing frame 16 and to hold the weather stripping 13 in good sealing relationship with the window-casing frame 16. It has been found that if a hoop-and-loop fastener element is formed continuously about the margin 18 of the transparent sheet of plastic 11 that the transparent sheet of plastic 11 is too difficult to remove from a window-casing frame and the price of the insulating window 10 is increased considerably.

The loop, hook-and-loop fastener elements 12 are preferably of the cloth type sold under the Trademark "VELCRO". Only the loop portions of the fasteners form the elements 12 on the transparent sheet of plastic. Complementary hook portions 20 of the fasteners are attached to the window-casing frame 16 in positions corresponding to the positions of the loop fastener elements 12. A reason the hook portions are used on the window-casing frame is that the hook portions are more regular in appearance and therefore are not as visible as the loop elements 12 would be when the transparent sheet of plastic 11 is not mounted on the window-casing frame. The loop elements 12 and the hook portions 20 are respectively mounted on the transparent sheet of plastic 11 and the window-casing frame by adhesives. The adhesives are chosen to respectively adhere to plastic and wood.

The weather stripping 13, in the FIGS. 1–3 embodiment, is formed of a resilient plastic tube which extends continuously about the margin of the transparent sheet of plastic 11. In this respect, the weather stripping 13 is formed of a plastic which compresses easily when urged against the window-casing 16 as is depicted in FIG. 3. The weather stripping 13 is mounted inside the loop, hook-and-loop fastener elements 12 at the side and top margins of the transparent sheet of plastic 11, but at the bottom margins the weather stripping **13*a* is attached to the lower edge 22 of the transparent sheet of plastic 11 so as to form a seal with a window sill 24 when the insulating window 10 is mounted. Again, the weather stripping is adhered directly to the transparent sheet of plastic 11** by means of an appropriate adhesive.

A knob 26 is fastened directly to the transparent sheet of plastic 11 close to the lower margin thereof. The knob 26 enables a person to easily grip the insulating window 10 to remove it from the window-casing frame 16.

In operation of the FIGS. 1–3 embodiment, the rectangular sheet of plastic 11 must be cut to fit the window-casing frame 16. This can be done by use of mass assembly methods for standard size windows or it can be custom performed for particular size windows. Thereafter, loop fastener elements 12 are adhered about the periphery of the transparent sheet of plastic 11, each element being spaced approximately 10 inches from the adjacent elements. As depicted in FIG. 1, there should be a loop fastening element positioned at the corners of the transparent sheet 11. The weather stripping 13 is then adhered about the margin of the transparent sheet 11. It should be appreciated that all of these steps can be accomplished with a minimum of measuring. In this respect, only the size of the transparent sheet 11 and the distance between the fastening elements 12 must be measured.

Once the insulating window 10 is prepared, it is placed on the window casing 16 to see where the loop fastening portions 20 must be placed to correspond to the loop fastening elements 12. Thereafter, hook fastening portions 20 are adhered to the window-casing frame 16 and the insulating window 10 is mounted on the window-casing frame 16 by pressing the loop fastening elements 12 against the hook fastening portions 20. The insulating window 10 will remain firmly in position so long as desired, but it will be easily removable from the window-casing frame 16 by simply pulling outwardly on the knob 26. The insulating window 10 provides a good seal with the window-casing 16 and the sill 24 but yet also presents a good appearance. In this respect, the thickness of the transparent sheet 11 makes it solid and luxurious in appearance without having waves therein. The distance between the fastening elements 12, in cooperation with the sheet thickness, is appropriate for maintaining the seal between the weather stripping 13 and the window-casing frame 16 and for preventing waves or warps in the transparent sheet 11. If it is desired, the outside face of the transparent sheet 11 can be painted about its margin 28 the same color, as the window-casing frame 16 to make the insulating window 10 even less noticeable. In the event that the insulating window 10 is detected, however, it has a luxurious, solid and pleasing appearance.

The embodiment of FIG. 4 differs from the embodiment of FIGS. 1–3 in that a weather stripping 30 is flat, rather than being tubular in shape, and is only mounted between the hook-and-loop fastener elements 12, rather than being mounted inside these elements as is the weather stripping 13 of FIG. 1. In this regard, the hook-and-loop fastener elements 12 have a certain amount of insulating qualities themselves.

In FIG. 5, an embellishment of the invention is disclosed wherein rotatable, loop-type handles 32 are attached to the transparent sheet of plastic 11 rather than the knob 26. The loop-type handles rotate about mounting pins 34, which are attached firmly to the transparent sheet of plastic 11. The loop-type handles 32 hang below the lower edge of the sheet of plastic 11 so that they not only can be used to pull the insulating window 10 from a window-casing 16, but also can be used for hanging the insulating window 10 from nails for storage.

While the invention has been particularly shown and described with reference to a preferred embodiment, it will be understood by those skilled in the art that various changes in form and detail may be therein without departing from the spirit and scope of the invention. For example, the loop-type handles 32 of FIG. 5 can be used with either of the embodiments disclosed. Further, other types of weather stripping and hook-and-loop fasteners can be used than those specifically described herein. In addition, various colored hook-and-loop fasteners and weather stripping could be used to match the colors of existing window-casing frames. Or, in the alternative, transparent elements could be used so that the colors of window-casing frames are viewed from the outside surfaces of transparent sheets of plastic. Also, where the insulating window 10 is to be mounted on a window that does not have a window sill, the hook-and-loop fasteners and the weather stripping at the bottom edge of the sheet of plastic 11 is arranged similarly as the fasteners and weather stripping located at the top and side edges thereof.

The embodiments of the invention in which an exclusive property or privelege are claimed are defined as follows:

1. An insulation window system comprising:

a transparent, rigid sheet of plastic to be mounted on internal, in situ, window frames of buildings, said sheet of plastic having an outer face, an inner face, and a margin about the edge thereof;

a fastening means including separable, mating, hook-and-loop fastening portions, a first portion of said hook-and-loop fastening portions including a plurality of elements, said elements each comprising a first attaching means for individually attaching said elements directly to the inner face of said sheet of plastic at spaced intervals about the margin thereof, a second portion of said hook-and-loop fastening portions including a plurality of elements, said elements each comprising a second attaching means for individually attaching said elements directly to said in situ window frames in spaced positions complementary to the positions of said elements of said first fastening portion; and, a weather stripping including a third attaching means for attaching said weather stripping directly to the inner face of said sheet of plastic about the margin thereof to form a seal between said sheet of plastic and said in situ window frames when said rigid sheet of plastic is mounted on said window frames with complementary elements of said hook-and-loop fastening portions engaged.

2. An insulation window system as claimed in claim 1 wherein said transparent, rigid sheet of plastic is at least ⅛ inch thick.

3. An insulation window system as in claim 2, wherein said sheet of plastic is approximately 3/16 inch thick.

4. An insulation window system as in claim 1 wherein said weather stripping is mounted on said transparent, rigid sheet of plastic only between said elements of said hook-and-loop first fastening portion.

5. An insulation window system as in claim 4 wherein is further included at least one handle mounted directly on said transparent, rigid sheet of plastic.

6. An insulation window system as in claim 5 wherein said at least one handle is in the form of a rotatable loop which can be rotated to extend beyond an edge of said rigid sheet of plastic.

7. An insulation window system as in claim 4 wherein is further included at least one handle mounted directly on said transparent, rigid sheet of plastic.

8. An insulation window system as in claim 7 wherein said at least one handle is in the form of a rotatable loop which can be rotated to extend beyond an edge of said rigid sheet of plastic.

9. A method of fabricating an insulation window system comprising:

cutting a transparent, rigid sheet of plastic, to have dimensions to overlap the window-casing frame of an in situ window;

adhering separate units of a cloth-type hook-and-loop fastening portion about the margin of said rigid sheet of plastic so that said units are spaced from one another along said margin;

adhering a weather stripping directly to said rigid sheet of plastic about the margin thereof to form a seal between said sheet of plastic and said in situ window-casing frame when said rigid sheet of plastic is mounted on said window frame; and, mounting complementary hook-and-loop fastening portions on said window frame at positions corresponding to the positions of said hook-and-loop fastening portions on said transparent rigid sheet of plastic.

10. A method as in claim 9 wherein said rigid sheet of plastic is at least ⅛ inch thick.

11. A method as in claim 10 wherein said rigid sheet of plastic is around 3/16 inches thick.

12. A method as in claim 9 wherein during the step of adhering said weather stripping to said rigid sheet of plastic said weather stripping is positioned only between the hook-and-loop fastening portions.

13. A method as in claim 12 wherein is further included the step of attaching a handle directly to the rigid-sheet of plastic.

14. The method as in claim 13, wherein said handle includes a loop which hangs below the lower edge of the rigid sheet of plastic.

15. A method as in claim 10 wherein is further included the step of attaching a handle directly to the rigid sheet of plastic.

16. The method as in claim 15 wherein said handle includes a loop which hangs below the lower edge of the rigid sheet of plastic.

17. An insulation window system comprising:

a transparent, rigid sheet of plastic to be mounted on internal, in situ, window frames of buildings, said sheet of plastic having an outer face, an inner face, and a margin about the edge thereof;

a fastening means including separable, mating, fastening portions, a first portion of said fastening portions including a plurality of spaced elements, said elements each comprising a first attaching means on one side thereof for individually attaching said elements to the inner face of said sheet of plastic at spaced intervals about the margin thereof, said first-portion elements having on the opposite side thereof pluralities of small first engaging members uniformly distributed across relatively broad areas of said first-portion elements facing away from said sheet of plastic when said first portion elements are mounted on said sheet of plastic, a second portion of said fastening portions including a plurality of elements, said elements each comprising a second attaching means on one side thereof for individually attaching said elements to said in situ window frames in positions complementary to the positions of said first-portion elements, said second portion having on the opposite side thereof a plurality of small second engaging members for engaging said first engaging members, said second engaging members being uniformly distributed across relatively broad areas of said secondportion elements facing away from said in situ window frames when said second-portion elements are mounted on said window frames; and, a weather stripping including a third attaching means for attaching said weather stripping to said sheet of plastic about the margin thereof to form a seal between said sheet of plastic and said in situ window frames when said rigid sheet of plastic is mounted on said window frames with said hook-and-loop fastening portions engaged.

* * * * *